United States Patent [19]

Williamson

[11] Patent Number: 4,635,806

[45] Date of Patent: Jan. 13, 1987

[54] SAFETY CAP

[76] Inventor: Vere A. Williamson, 42 Oxford Street, Strathfield, New South Wales 2135, Australia

[21] Appl. No.: 779,412

[22] Filed: Sep. 24, 1985

[51] Int. Cl.[4] ..... B65D 55/02

[52] U.S. Cl. ..... 215/220; 215/DIG. 1

[58] Field of Search ..... 215/220, 219, DIG. 1

[56] References Cited

U.S. PATENT DOCUMENTS

| | | | |
|---|---|---|---|
| 3,472,411 | 10/1969 | Turner | 215/220 |
| 4,330,067 | 5/1982 | Deussen | 215/220 |
| 4,555,036 | 11/1985 | Bekkers et al. | 215/220 |

*Primary Examiner*—George T. Hall

[57] ABSTRACT

A safety cap includes a cowling containing an internally threaded closure member. The top of the closure member is provided with a central conical boss engaged by a cylindrical split ring on a top panel of the cowling to normally bias the two components into a first position. Downward pressure upon the cowling to a second position engages teeth on the two components to permit turning of the threaded closure member. The biasing action between the two components when moved between the first and second positions is enhanced by a tapering of the thickness of the cowling top panel to its minimum thickness juxtaposed the split ring. The lower portion of the closure member may include a series of saw tooth ridges to facilitate its retention during fabrication.

2 Claims, 6 Drawing Figures

SAFETY CAP

This invention relates to safety caps which prevent the inadvertent opening of bottles by children. More particularly it is concerned with bottle caps having an inner closure member which removably seals the mouth of a bottle and cowling which fits over this closure member.

With these caps the cowling is normally fitted over the closure member in such a way that it may be depressed from a first position (wherein it is freely rotatable relative to the closure member) to a second position in which it engages this member. A biasing mechanism may also be provided which urges the cowling to its disengaged position. The nature of these mechanisms is normally such that the force required to initially depress the cowling is greater than that necessary to subsequently maintain the engagement. If the cap once fitted to a bottle is to be removed the outer cowling must therefore be first pushed downwardly to engage the closure member and then subsequently rotated while being held in this depressed position. It is this multiplicity of operations which serves to prevent the cap being removed by young children.

It is an object of this invention to provide a safety cap having an inproved biasing mechanism and means of engaging the outer cowling and closure member. Accordingly this invention in one broad form discloses a safety cap which includes; an inner closure member adapted to removably seal the mouth of a bottle, a cowling fitted over the closure member in such a manner as to be movable between a first position wherein it is freely rotatable in at least one direction and a second position wherein it engages said closure member so that subsequent rotation of the cowling serves to remove said closure member, and a biasing mechanism which is adapted to urge the cowling to said first position, said baising mechanism comprising a conical projection and a split ring located centrally of said cap and between said closure member and cowling.

Preferably as described below the conical projection is located on the closure member and the split ring is formed on the interior face of the cowling. Both are also positioned centrally of the cap's rotational axis.

Figure 1:
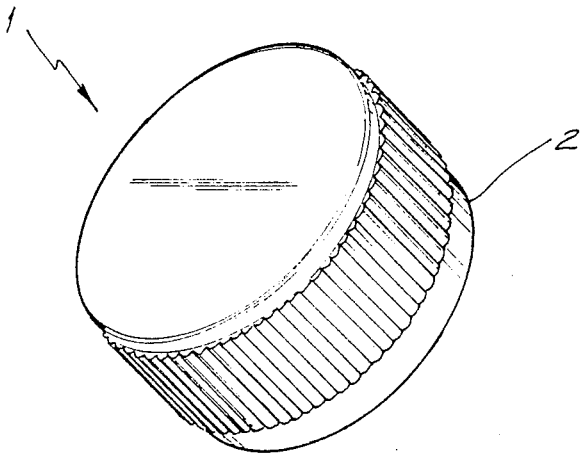
Figure 2:
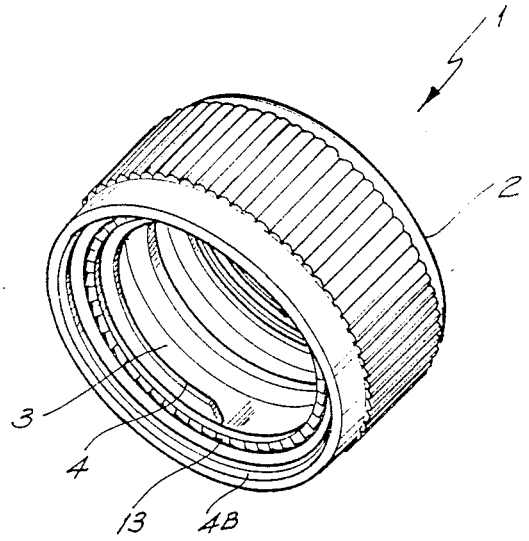
Figure 3:
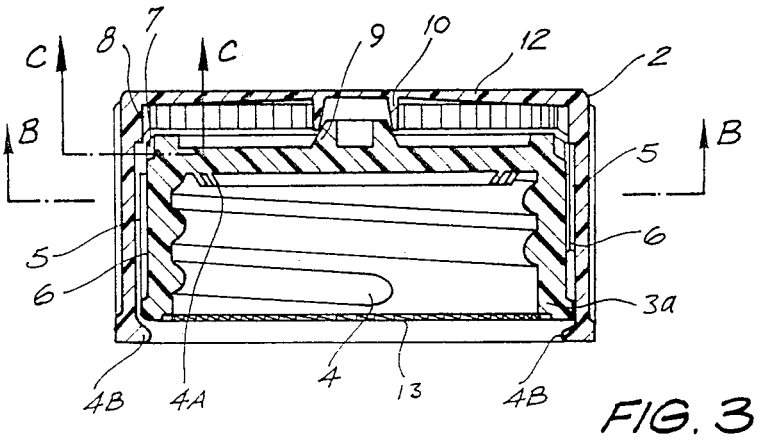
Figure 4:
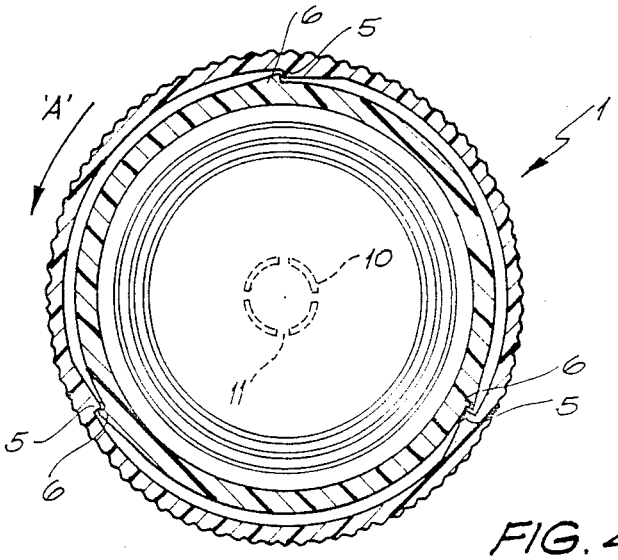
Figure 5:
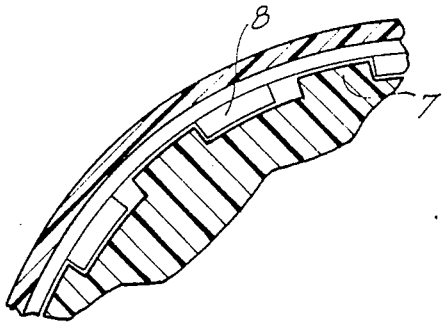
Figure 6:
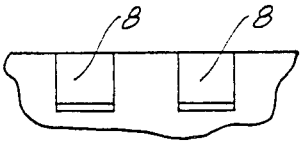

One preferred embodiment of this invention will now be described with reference to the attached drawings in which:

FIGS. 1 and 2 show perspective views of a safety cap according to this invention, FIG. 3 shows a cross-sectional view of the cap of FIGS. 1 and 2, FIG. 4 shows a cross-sectional view along the lines B—B of FIG. 3, FIG. 5 shows a fragmentary section along the lines C—C of FIG. 3, and FIG. 6 shows a detail of the teeth of FIG. 5.

Referring first to FIGS. 1 and 2 the cap 1 comprises an outer cowling 2 and a closure member 3 which fits within the cowling. Threads 4 are also formed within the closure member to enable it to be screwed onto a medicine bottle or the like and circumferential lips 4A are provided to seal against the mouth of the bottle. The diameter of the closure member as shown in FIG. 3 is slightly less than the interior dimensions of the cowling 2 so that one is able to rotate with respect to the other. In order to retain the closure member in place however there is a flange 4B around the inside rim of the cowling. With this embodiment a plastics material is used for the cap which is sufficiently resilient that these flanges deform to allow the closure member to be push fitted into the cowling during its initial assembly.

A set of bevelled lugs 5 and 6 are formed on the facing circumferential surfaces of the closure member and cowling as shown in FIG. 4 to ensure that the cowling is able to rotate freely in only one direction with respect to the closure member. Any rotation of the cowling in the direction of arrow 'A' is transmitted directly to the closure member when these lugs engage as illustrated.

Arranged around the upper periphery of the closure member and the adjacent interior of the cowling are sets of square teeth 7 and 8. Although these teeth are shown as being disengaged in FIG. 3 they are nevertheless adapted to interfit (see FIG. 5) when the cowling is depressed downwardly onto the closure member as described later.

To bias the closure member and cowling to their disengaged position a spring mechanism is provided which comprises a conical boss 9 extending centrally up from the top of the closure member and a cylindrical split ring 10 which is formed immediately above the boss 9 on the interior surface of the cowling. The lower edges of the split ring bear against the top of the boss in the manner indicated in FIG. 3 to prevent the teeth 7 and 8 from engaging and allow the cowling and closure member to rotate in at least one direction relative to one another as mentioned earlier. There are slots 11 in the split ring however and these as well as the nature of the cowling material enable the lower edges of the ring to resiliently deform outwardly over the boss 9 so that the cowling can be depressed down onto the closure member to engage the teeth 7 and 8. By virtue of the constant angle of inclination of the sides of the boss the force required to do this is substantially constant over the range of movement and has been found to provide a significant advantage over existing caps. Upon release of the cowling the split ring again returns to its undeformed configuation whereby the cowling is raised relative to the closure and the teeth 7 and 8 are disengaged.

As a further improvement over existing safety caps the top panel 12 is tapered towards its center as shown in FIG. 3. This construction enables the panel to also deform as the cowling is depressed down onto the closure member and enhances the resilient action of the biasing mechanism referred to earlier.

To facilitate the precision machining of the closure member during manufacture a series of saw tooth ridges 13 may also be formed into its lower skirt **3*a* during the moulding process. this enables the closure member to be more easily held during for example the cutting of the threads 4**.

In use the cap can be easily screwed onto a bottle by grasping the knurled sides of the cowling and rotating it in the direction shown by arrow 'A'. As mentioned earlier such rotation by virtue lugs 5 and 6 is transmitted directly to the closure member without any additional manipulation or force needing to be applied to the cap. Once the cap is tightened onto the bottle however, simple reverse rotation of the cowling will not remove it as the inclined configuration of these lugs 5 and 6 would allow it to turn freely without engaging the closure member. To remove the cap it would then be necessary to first depress the cowling onto the closure member so as to overcome the biasing effect of the split ring and boss and engage the teeth 7 and 8. With these teeth engaged the cowling and closure member are locked together and the cap can be unscrewed from the bottle.

It will thus be appreciated that this invention at least in the form of the embodiment described provides a novel and unique improvement in safety caps. Clearly however the particular example disclosed is only one form of this invention and a wide variety of modifications may be made which would be apparent to a man skilled in the art. For example the invention is not limited to any particular size or relative proportions for the cap or any specific material for its construction.

I claim:

1. A safety cap which includes; an inner closure member provided with a skirt and adapted to removably seal the mouth of a bottle, a cowling having a top panel and fitted over the closure member in such a manner as to be movable between a first position where it is freely rotatable in at least one direction and a second position where it engages said closure member so that subsequent rotation of the cowling serves to remove said closure member, a biasing mechanism adapted to urge the cowling to said first position, said biasing mechanism comprising a conical projection and a split ring located centrally of said cap and between the closure member and cowling, the thickness of said top panel of the cowling being tapered to its minimum thickness towards its center so that said panel more easily deforms as the cowling is depressed onto the closure member to thereby enhance the resilient action of said biasing mechanism, and a series of saw tooth ridges disposed on the lower portion of said skirt of the closure member during the moulding thereof to facilitate the subsequent cutting of threads around the interior of said closure member.

2. The safety cap as claimed in claim 1 including, a plurality of radially-spaced circumferential lips disposed upon the interior of said closure member to seal against the mouth of the bottle when the cap is fitted thereto.

* * * * *